US009523199B2

(12) United States Patent
Flick

(10) Patent No.: US 9,523,199 B2
(45) Date of Patent: Dec. 20, 2016

(54) IMPACT RESISTANT CLADDING CONSTRUCTION MATERIAL HAVING A LAYERED STRUCTURE FOR USE AS A PANEL FOR FLOOR, WALL OR ROOF

(71) Applicant: Jerry Flick, Coral Gables, FL (US)

(72) Inventor: Jerry Flick, Coral Gables, FL (US)

(73) Assignee: Fortified Housing, LLC, Vero Beach, FL (US)

( * ) Notice: Subject to any disclaimer, the term of this patent is extended or adjusted under 35 U.S.C. 154(b) by 25 days.

(21) Appl. No.: 14/671,497

(22) Filed: Mar. 27, 2015

(65) Prior Publication Data

US 2015/0275518 A1 Oct. 1, 2015

Related U.S. Application Data

(60) Provisional application No. 61/971,001, filed on Mar. 27, 2014.

(51) Int. Cl.

| | |
|---|---|
| ***B32B 13/06*** | (2006.01) |
| ***E04C 2/24*** | (2006.01) |
| ***E04C 2/38*** | (2006.01) |
| ***E04C 2/26*** | (2006.01) |
| ***E04C 2/28*** | (2006.01) |

(52) U.S. Cl.
CPC . *E04C 2/24* (2013.01); *E04C 2/26* (2013.01); *E04C 2/28* (2013.01); *E04C 2/38* (2013.01); *Y10T 428/24752* (2015.01); *Y10T 428/24967* (2015.01)

(58) Field of Classification Search
CPC ..... B32B 3/26; B32B 15/10; B32B 13/06; E04C 2/28
USPC ..... 428/60, 464, 537.1
See application file for complete search history.

(56) References Cited

U.S. PATENT DOCUMENTS

2010/0326011 A1* 12/2010 Norling ..... B27D 1/04 52/796.1

* cited by examiner

*Primary Examiner* — Alexander Thomas
(74) *Attorney, Agent, or Firm* — Locke Lord LLP; Howard M. Gitten

(57) ABSTRACT

The present invention is related to an impact resistant panel for building construction, and, more particularly is related to panels having a multilayered structure having three or more layers and which may be interconnected to form a resistant surface for a floor, wall or roof of a building. The panel includes a first cladding board layer. An impact layer is affixed to the first cladding board layer and has a toughness to prevent penetration upon impact from flying items travelling due to high wind storms. A second cladding board layer is affixed to the opposite side of the impact resistant layer from the first cladding board layer.

4 Claims, 3 Drawing Sheets

IMPACT RESISTANT CLADDING CONSTRUCTION MATERIAL HAVING A LAYERED STRUCTURE FOR USE AS A PANEL FOR FLOOR, WALL OR ROOF

CROSS REFERENCE TO RELATED APPLICATION

This application claims the benefit of priority under 35 U.S.C. §119(e) to U.S. Provisional Patent Application No. 61/971,001, filed Mar. 27, 2014, the entire contents which is incorporated herein by reference in its entirety.

BACKGROUND OF THE INVENTION

The present invention is related to a structural, cladding, and impact resistant panel for building construction, and, more particularly is related to panels having a multilayered structure of three or four materials adhered to each other mechanically or by adhesives and which may be interconnected to form an impact resistant surface for sub-floor, exterior/interior wall cladding and/or roof of a building.

While structural and impact resistant materials are known in the art, thousands of homes each year suffer from high wind, stress and projectile damage as a result of being in a high velocity coastal area such as hurricane and tornado regions.

It is known for example, in U.S. Pat. No. 5,768,841 to place a metal sheet behind a wallboard structure, such as a gypsum panel. This wallboard structure is then attached to the framing studs of a building with a metal sheet adjacent the studs so that the metal sheet resists in plane or shear loads imposed upon the framing structure of the building. This is to keep the wallboard panel from penetration by foreign objects. However, this patent suffers from the deficiencies that with nothing behind the metal sheet it can bend and warp from the load over time, lessening the panel's overall impact resistance.

From U.S. Pat. No. 7,637,073, it is known to provide a wall structure to provide protection against ballistic projectiles impacting the wall. Again, the wall structure includes an outer panel and an inner panel, the inner panel is a composite structure that includes a metal sheet attached to a wallboard panel and a sheet of self-healing material attached to the opposed face of the metal sheet with a cavity formed between the outer and inner panels. Sand is then added to the interior of the wall to provide the necessary density and impact resistance. While satisfactory, the '073 patent suffers from the deficiencies that it requires shipping of sand to the construction site and pouring of sand into all of the exterior walls of the house; driving up the construction time and cost.

BRIEF SUMMARY OF THE INVENTION

A structural impact resistant cladding board for use as a panel for an exterior or interior wall, sub-floor, floor, or roof panel, includes a first panel layer formed of a construction board material. The first panel layer is affixed to a second layer having a toughness sufficient to prevent fracture upon impact by a dislodged object flying through the air under high winds such as hurricane, i.e. between 119 km/h and 251 km/h. A second panel layer, a third overall layer, is affixed to the opposed side of the second layer and is formed of a construction board material.

In a first embodiment, the first, second and third layers are coextensive with each other. In a second embodiment, the second and third layers are coextensive with each other. In yet another embodiment, the first and second layers are coextensive with each other while the third layer is not.

BRIEF DESCRIPTION OF THE DRAWINGS

The foregoing aspects and other aspects of this disclosure are described in detail below in connection with the accompanying drawing figures in which.

DETAILED DESCRIPTION OF THE PREFERRED EMBODIMENTS

Figure 1:
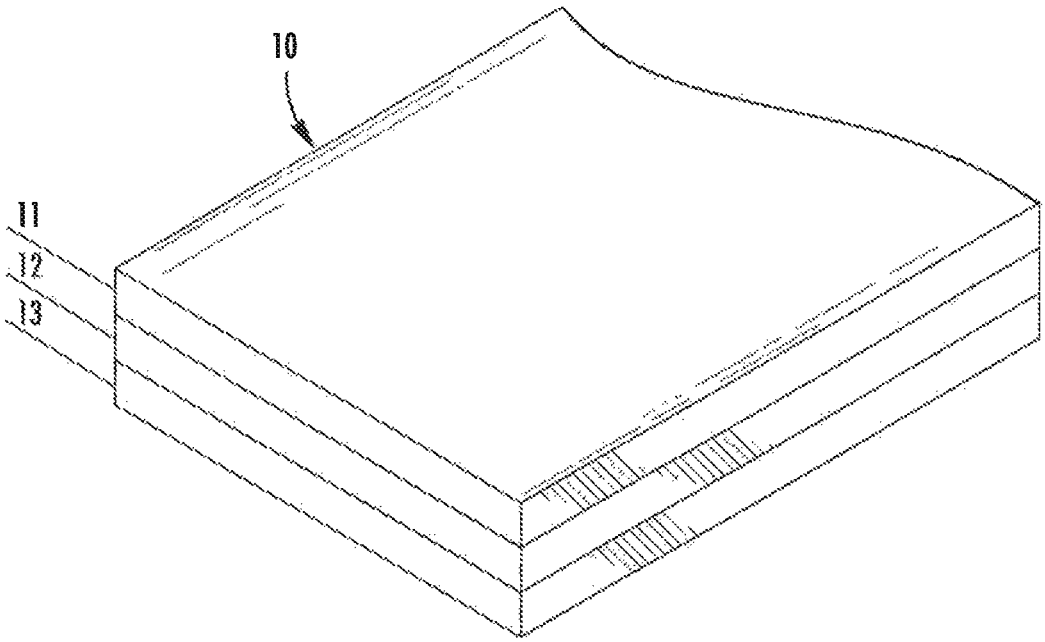
FIG. 1 is a perspective illustration of the assembled impact resistant panel; the unshown part of the panel is a mirror image of that which is shown.

Reference is made to FIG. 1 in which an impact resistant panel generally indicated as 10 is shown. Panel 10 includes three layers of distinct materials. A first cladding layer 13 is a conventional construction material; made from a construction board material. Cladding layer 13 may be a board made of plywood, drywall, fiber, cement, fiber flex, magnesium cement, board, stucco, or other known non-metallic construction material commonly used as a surface for a wall, floor or roof. In a preferred but non-limiting embodiment, cladding layer 13 has a thickness of at least 3 millimeters; but less than the common cladding thickness.

An interior layer 12 is an impact resistant layer and is coextensive with layers 11 and 13. Layer 12 has a toughness such that it is not penetrated upon impact from loose flying debris caused by windstorms. The interior layer 12 is made from a material which is significantly more impact resistant than the cladding materials of layer 13.

In a preferred but non-limiting embodiment, layer 12 has an impact resistance (toughness as known in the art) equal or exceeding the compressive strength of 28 gauge steel. Layer 12 may be made by way of example of steel sheet, corrugated steel, steel mesh sheets, fiberglass mesh, road mesh, steel grill, or polymer sheets or mesh having an equal toughness value. Layer 12 is affixed to layer 13 to prevent movement relative to each other. The thickness of the materials can be increased depending on the use and engineering requirements of each layer and subject to the local minimum building codes.

A second cladding layer 11 is mounted on layer 12. Cladding layer 11 is also made of a construction material such as plywood, drywall, fiber cement, fiberglass, magnesium board, fiber cement board, magnesium cement board, stucco, polymer fiberglass matte, Densdeck® or Densglass®, or any other sufficiently stiff material as known in the art. Again, the thickness of layer 13 is at least three millimeters. Each of the layers 11-13 may be secured together or to each other by any one of adhesives, screws, or clamps forming a single panel 10 for use in construction. By creating a sandwich of two or more materials about the interior layer 12, interior impact resistance layer 12 is in effect encapsulated preventing bending of interior layer 12, increasing the ability of layer 12 to act as an impact barrier. As a result, an improved nonflexible structural sandwich panel is provided.

It should be noted, that for the embodiment in FIG. 1 as well as the embodiments to be described below, that impact resistant panel 10 may be used as a support panel directly mounted to the structural framing of a building, or may be the outer structural layer, i.e., mounted to conventional drywall (for indoors), or other cladding material (for indoors or outdoors).

Figure 2:
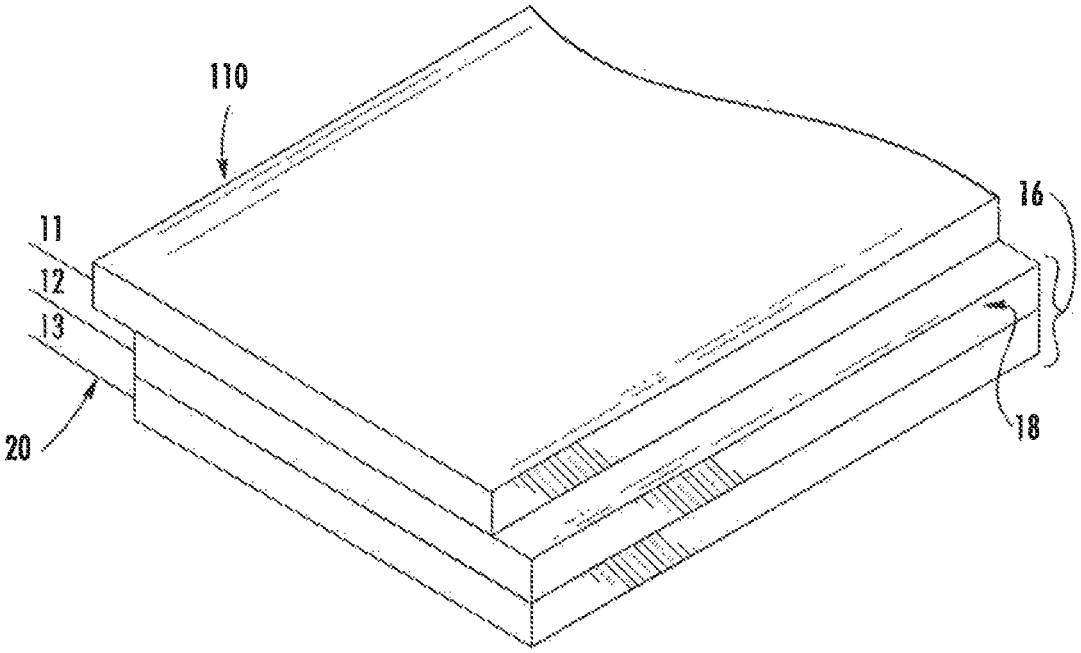
FIG. 2 is a perspective view of an overlapping impact resistant panel constructed in accordance with a second embodiment of the invention; the unshown portion of the panel is a mirror image of the portion which is shown.

Reference is now made to FIG. 2 in which a panel constructed in accordance with another embodiment of the invention is provided. Like structures are indicated with like numerals. While panel 10 as seen in FIG. 1, overcomes the shortcomings of the prior art, and can be made in any size, when two or more panels 10 are placed together, a seam is formed at the position in which edges of adjacent panels 10 meet in a construction and may be relatively less impact resistant than the panel itself; and may be more susceptible to water seepage through the adjacent panels.

As seen in FIG. 2 an offset embodiment panel 110 of the invention is provided. Layers 12 and 13 are offset relative to layer 11 to produce a ledge 16. Ledge 16 is formed at a first edge 18 of panel 12 and an overhang 20 by panel 11 at the opposed edge of panel 110 from edge 18. In this way, when a first panel 110 is mounted adjacent a second panel 110, overhang 20 overlaps and cooperates with ledge 16 at edge 18 so that there are no longer seams through the entire assembly at the edge of each panel. The panels can be affixed to each other at the overlap of ledge 16 and overhang 20 utilizing adhesives, screws, nails or clamps as known in the art. The third layer is offset to provide overlapping of the next board to assistance in preventing water penetration and added structural integrity to impact.

Figure 3:
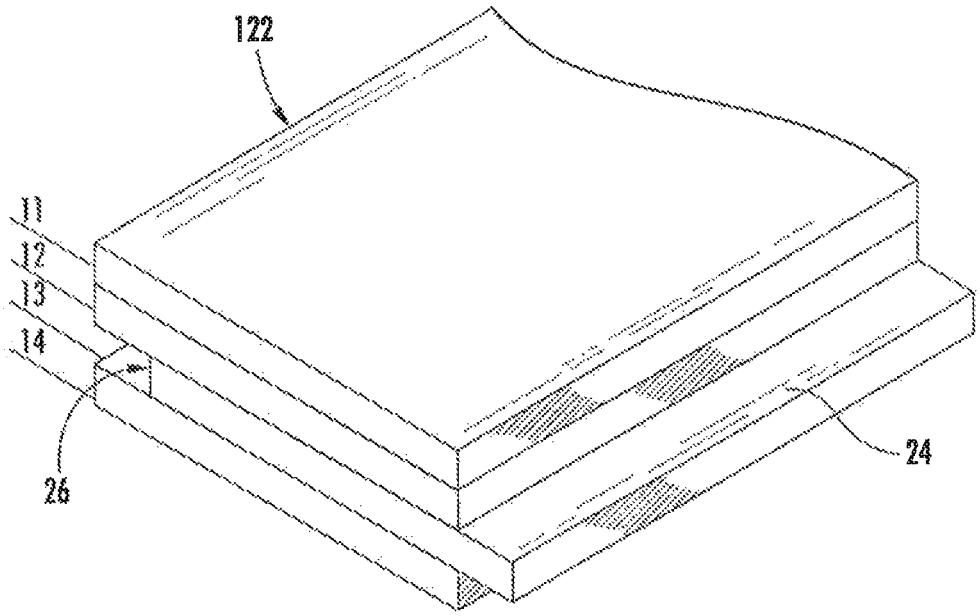
FIG. 3 is a perspective view of a tongue and groove impact resistant panel constructed in accordance with another embodiment of the invention; the unshown portion of the panel is a mirror image of the portion which is shown.

Reference is now made to FIG. 3 in which a siding generally indicated as 122, constructed in accordance with yet another embodiment of the invention is provided. In this embodiment of the invention, a single cladding layer is offset relative to others, to provide a tongue and groove structure. The primary difference being that a single layer is offset relative to the remaining layers. Like numbers are utilized to indicate like structure.

Outer cladding layer 11 and impact resistance layer 12 are affixed to each other as described above with screws, clamps, adhesives or by other means and are preferably coterminous with each other. The formerly outer cladding layer 13 is offset relative to impact resistant layer 12. A fourth layer, a third cladding layer, 14 is provided and mounted to cladding layer 13. Fourth layer 14 is also made of board material and is coterminous with layers 11 and 12. In this manner, a tongue 24 and groove 26 is formed by the offset of cladding layer 13.

In this manner, the tongue 24 is received in the groove 26 of adjacent boards 22 when placed side by side. In this way, the underlying layer 14 provides support for board 24 even in the absence of an underlying metal layer.

While this invention has been particularly shown and described to reference the preferred embodiments thereof, it will be understood by those skilled in the art that various changes in form and detail may be made therein without departing from the spirit and scope of the invention encompassed by the appended claims.

What is claimed as new and is desired to be protected by Letters Patent, of the United States is:

1. An impact resistant construction material comprising:

a first cladding board layer, the cladding board layer being formed from at least one of drywall, cement, and magnesium cement;

an impact resistant layer, having a toughness greater than a toughness of the first cladding board layer, affixed to the first cladding board layer on a first side of the impact resistant layer, the impact resistant layer having a toughness to withstand penetration upon impact from flying objects caused by high winds, the toughness being greater than or equal to the compressive strength of 28 gauge steel;

a second cladding board layer affixed to the impact resistant layer on a side of the impact resistant layer opposed to the first side.

2. The impact resistant panel of claim 1, wherein the first cladding board layer is coterminous with the impact resistant layer and the second cladding board layer.

3. The impact resistant panel of claim 1, wherein the first cladding board layer is offset relative to the impact resistant layer and second cladding board layer, the second cladding board layer being coterminous with the impact resistant layer.

4. The impact resistant panel of claim 1, further comprising a third cladding board layer affixed to the second cladding board layer, the second cladding board layer being offset relative to the first cladding board layer and third cladding board layer to form a tongue and groove.

* * * * *